US010150311B2

(12) United States Patent
Omagari

(10) Patent No.: US 10,150,311 B2
(45) Date of Patent: Dec. 11, 2018

(54) RECORDING APPARATUS AND RECORDING METHOD

(71) Applicant: CANON KABUSHIKI KAISHA, Tokyo (JP)

(72) Inventor: Yuki Omagari, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/581,435

(22) Filed: Apr. 28, 2017

(65) Prior Publication Data

US 2017/0341433 A1 Nov. 30, 2017

(30) Foreign Application Priority Data

May 31, 2016 (JP) ..... 2016-109507

(51) Int. Cl.
*B41J 13/00* (2006.01)
*B41J 11/58* (2006.01)

(52) U.S. Cl.
CPC ..... *B41J 13/0009* (2013.01); *B41J 11/58* (2013.01)

(58) Field of Classification Search
CPC ..... B41J 13/0009; B41J 11/58
See application file for complete search history.

(56) References Cited

U.S. PATENT DOCUMENTS 7,401,879 B2 * 7/2008 Isono ..... B41J 13/14 347/16
9,098,782 B2 8/2015 Uratani
2004/0017462 A1 * 1/2004 Takahashi ..... B41J 3/4071 347/104
2004/0263545 A1 * 12/2004 Esaki ..... B41J 3/4071 347/5
2005/0117947 A1 * 6/2005 Shiaku ..... B41J 3/4071 400/48
2006/0080687 A1 * 4/2006 Miyashita ..... B41J 3/4071 720/603

FOREIGN PATENT DOCUMENTS

JP 2004-338338 12/2004

* cited by examiner

*Primary Examiner* — Jason Uhlenhake
(74) *Attorney, Agent, or Firm* — Fitzpatrick, Cella, Harper & Scinto

(57) ABSTRACT

A recording apparatus performs recording on a recording medium by using a tray having a plurality of slots, and includes a reception unit receiving information for specifying a detection position of the recording medium in a slot of the tray from an external apparatus, and a specification unit to specify the detection position. In addition, a control unit controls the recording apparatus so that, in a case where the recording medium is arranged in a first slot and no recording medium is arranged in a second slot, recording processing is performed on the recording medium arranged in the first slot, and recording processing is not performed in association with the second slot. Detection processing to detect a recording medium is not performed for a third slot which is not specified, and detection processing is performed for the first and second slots which are specified.

19 Claims, 12 Drawing Sheets

| ID | TRAY NAME | NUMBER OF SLOTS | X COORDINATE OF MEDIUM DETECTION POSITION | Y COORDINATE OF MEDIUM DETECTION POSITION |
|---|---|---|---|---|
| 30801 | TWO-STAR-TYPE | 2 | 30,90 | 30,90 |
| 30802 | FOUR-RING-TYPE | 4 | 30,90,30,90 | 30,30,90,90 |
| 30803 | TWO-CARD-TYPE | 2 | 50,50 | 40,80 |
| 30804 | FOUR-TRIANGLE-TYPE | 4 | 30,90,30,90 | 30,30,90,90 |

FIG.9

RECORDING APPARATUS AND RECORDING METHOD

BACKGROUND OF THE INVENTION

Field of the Invention

The invention relates to a recording apparatus and a recording method, and more particularly, to a recording apparatus that performs recording while retaining a recording medium such as a disc by a tray, and a recording method thereof.

Description of the Related Art

Unlike sheets such as paper generally used for recording, a recording medium such as a disc has high hardness. Therefore, in a case where an image is recorded (printed) on the surface of a recording medium such as a disc by an inkjet recording apparatus or the like, instead of a sheet conveying mechanism, a disc is arranged on a tray, and recording is performed on the surface of the disc by using a mechanism for conveying the tray.

Japanese Patent Laid-Open No. 2004-338338 discloses a technology capable of using media having various shapes by arranging a recording medium such as a disc (hereinafter, simply referred to as a "medium") on a tray through an adapter. In addition, it is determined whether or not a medium suitable for the adapter is arranged in the tray, and if there is an error, a notice indicating the message is issued to a user.

Among the trays mounted to the recording apparatus, there are trays provided with slots having arbitrary shapes and trays provided with slots at arbitrary positions. In a case of using these trays, the recording apparatus may not recognize whether or not a medium is actually arranged in the slot. For this reason, for example, there is a problem in that recording process is executed for a slot where no medium is arranged, and recording not intended by the user is performed.

SUMMARY OF THE INVENTION

According to an aspect of the invention, there is provided a recording apparatus for recording on a recording medium by using a tray having at least two stet slots where a recording medium can be arranged, including: a reception unit configured to receive input of information for specifying a detection position of the recording medium in a slot of the tray; a specification unit configured to specify the detection position on the basis of the information for specifying; and a control unit configured to control the recording apparatus so that, in a case where the recording medium is arranged in a first slot corresponding to the specified detection position and no recording medium is arranged in a second slot corresponding to the specified detection position, recording processing is performed on the recording medium arranged in the first slot, and recording processing is not performed on the recording medium arranged in the second slot.

Further features of the present invention will become apparent from the following description of exemplary embodiments with reference to the attached drawings.

BRIEF DESCRIPTION OF THE DRAWINGS

FIG. 9 is a diagram illustrating recording-associated data;

DESCRIPTION OF THE EMBODIMENTS

Hereinafter, embodiments of the invention will be described in detail with reference to the accompanying drawings.

First Embodiment

[Hardware Configuration of Information Processing Apparatus]

Figure 1:
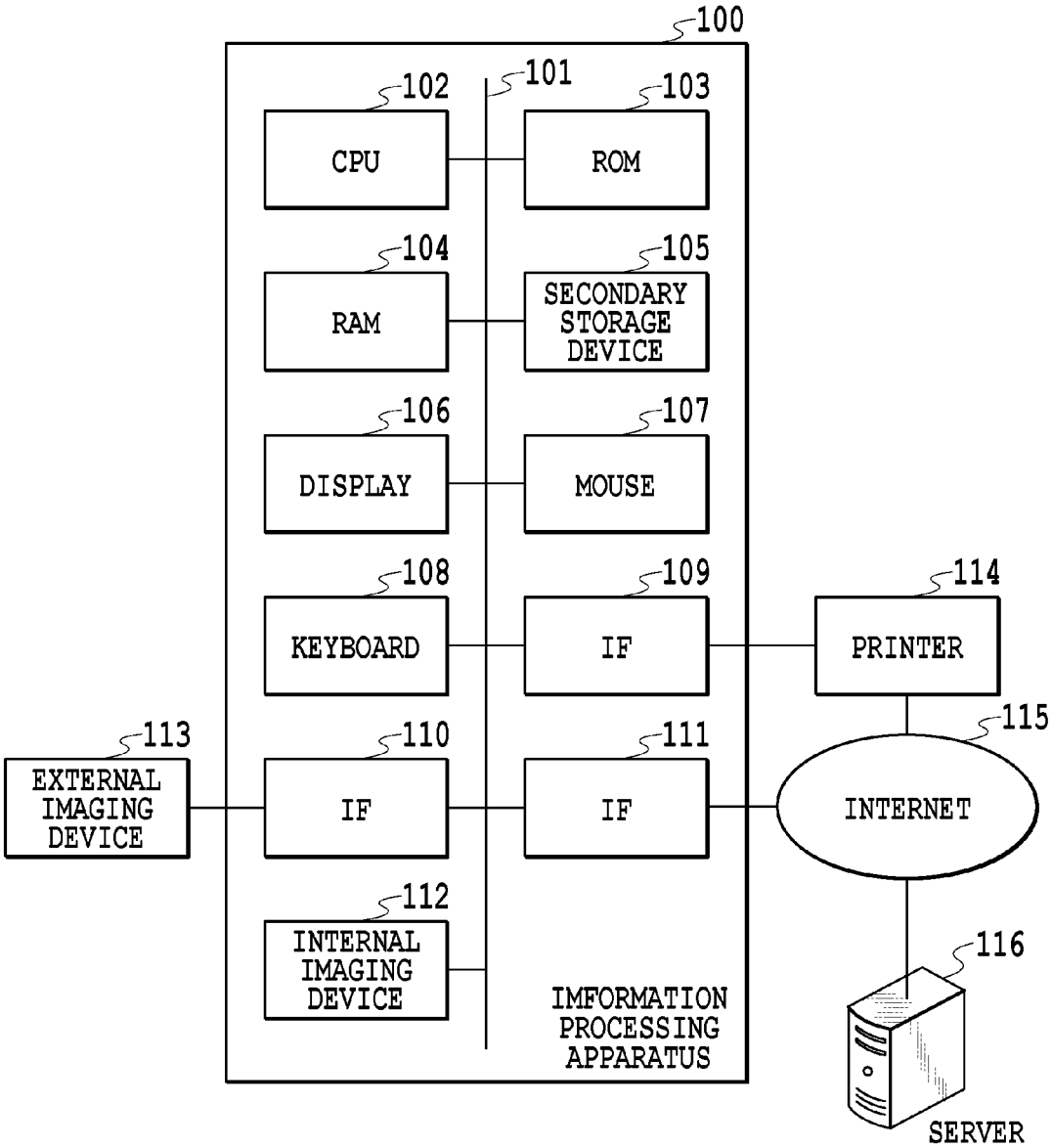
FIG. 1 is a block diagram illustrating a configuration of a recording system.

FIG. 1 is a block diagram illustrating a configuration of a recording system according to an embodiment of the invention. In the recording system according to this embodiment, an information processing apparatus 100, a printer 114 as a recording apparatus, and a server 116 are connected via a network. The information processing apparatus 100 corresponds to, for example, a portable information terminal such as a smartphone, a tablet PC, or a notebook PC or a non-portable desktop PC. Hereinafter, in this embodiment, a smartphone provided with a touch panel display will be described as an example of the information processing apparatus 100. In FIG. 1, a CPU (central processing unit/processor) 102 executes various processes such as processes described later in FIG. 10 in accordance with programs. In addition, one CPU 102 is illustrated in the figure, but a plurality of CPUs or CPU cores may be included. A ROM 103 stores programs that are to be executed by the CPU 102. A RAM 104 is a memory for temporarily storing various types of information in a case where the CPU 102 executes programs.

A secondary storage device 105 is a storage medium such as a hard disk and a flash memory and stores files, data of a database or the like for retaining processing results of image analysis and the like, and various programs. A display 106 displays a UI (user interface) for receiving an operation for realizing various processes described later in FIG. 6 and the like or various types of information of processing results or the like of the executed processes. The display 106 includes a touch sensor (not shown). The user can input operation by a touch operation such as touch, swipe, or pinch. As a UI, a mouse, a keyboard for inputting characters and the like may be provided.

An internal imaging device 112 performs imaging, and an image data obtained by the imaging undergoes predetermined image processing, and after that, the image data is stored in the secondary storage device 105. In addition, the image data may be read from an external imaging device 113 connected via an IF (interface) 110.

An IF 111 can communicate with an external apparatus via a network such as the Internet 115. IFs 109 to 111 are interfaces having at least one communication mode of wired communication and wireless communication and perform communication with the external apparatus (the printer 114 or the server 116) according to the communication mode to be used. The information processing apparatus 100 may obtain image data from the server 116 or the external imaging device 113 connected to the Internet 115 via the IFs 109 to 111 or may output image data or the like to the printer 114. As wired communication, there may be exemplified USB, Ethernet (registered trademark), and the like. As wireless communication, wireless LAN, NFC (Near Field Communication), Bluetooth (registered trademark), infrared communication, and the like may be used.

The above-described various components of the information processing apparatus 100 are mutually connected via an internal bus 101, and the CPU 102 controls various components via the internal bus 101. In addition, in this embodiment, the information processing apparatus 100 is an execution location (software execution environment) of software such as a program executed by the control unit (CPU 102) included in the information processing apparatus 100.

In addition, in this specification, a printer is described as an example of an external apparatus. However, the invention is not limited to the printer, and other image forming apparatuses such as a multifunction peripheral (MFP) may be used.

[Hardware Configuration of Recording Apparatus]

Figure 2:
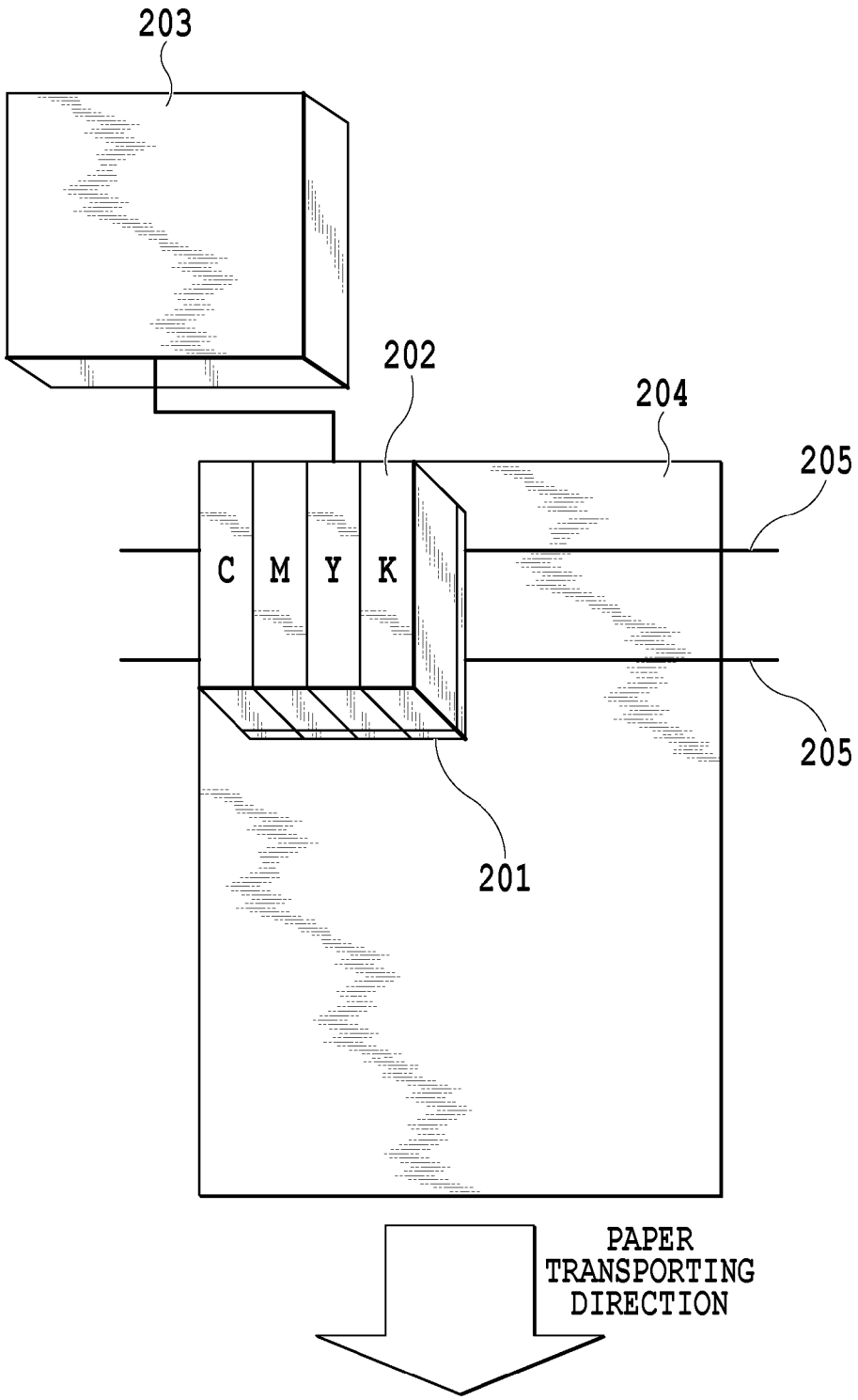
FIG. 2 is a diagram schematically illustrating a configuration of main components of a printer.

FIG. 2 is a diagram schematically illustrating a configuration of main components of the printer 114 illustrated in FIG. 1. A carriage (not shown) where a recording head 201 and an ink tank 202 storing ink are mounted is configured to be movable along a guide shaft 205. The ink tank 202 stores four color inks of black (K), yellow (Y), magenta (M), and cyan (C). In addition, with respect to the type of ink, any color of ink may be used. A control circuit unit 203 is configured to include a storage unit, a calculation unit, and a communication unit required for driving the recording head 201. The recording head 201 receives a recording signal and a control signal from the control circuit unit 203, and ejects ink based on the recording signal according to the control signal. A recording sheet 204 as a recording medium is conveyed by a conveying roller (not shown), and an image is formed on the sheet 204.

The printer 114 conveys the tray along a conveying path different from that of the sheet 204 by using the tray described later and performs recording by ejecting ink to a recording medium (hereinafter, also referred to as a "medium") such as a disc arranged on the tray. In addition to the above-described configuration, the printer 114 is configured to further include a paper feed unit, a paper transport unit, a paper discharge unit, and a recovery mechanism unit (cleaning unit).

Figure 3:
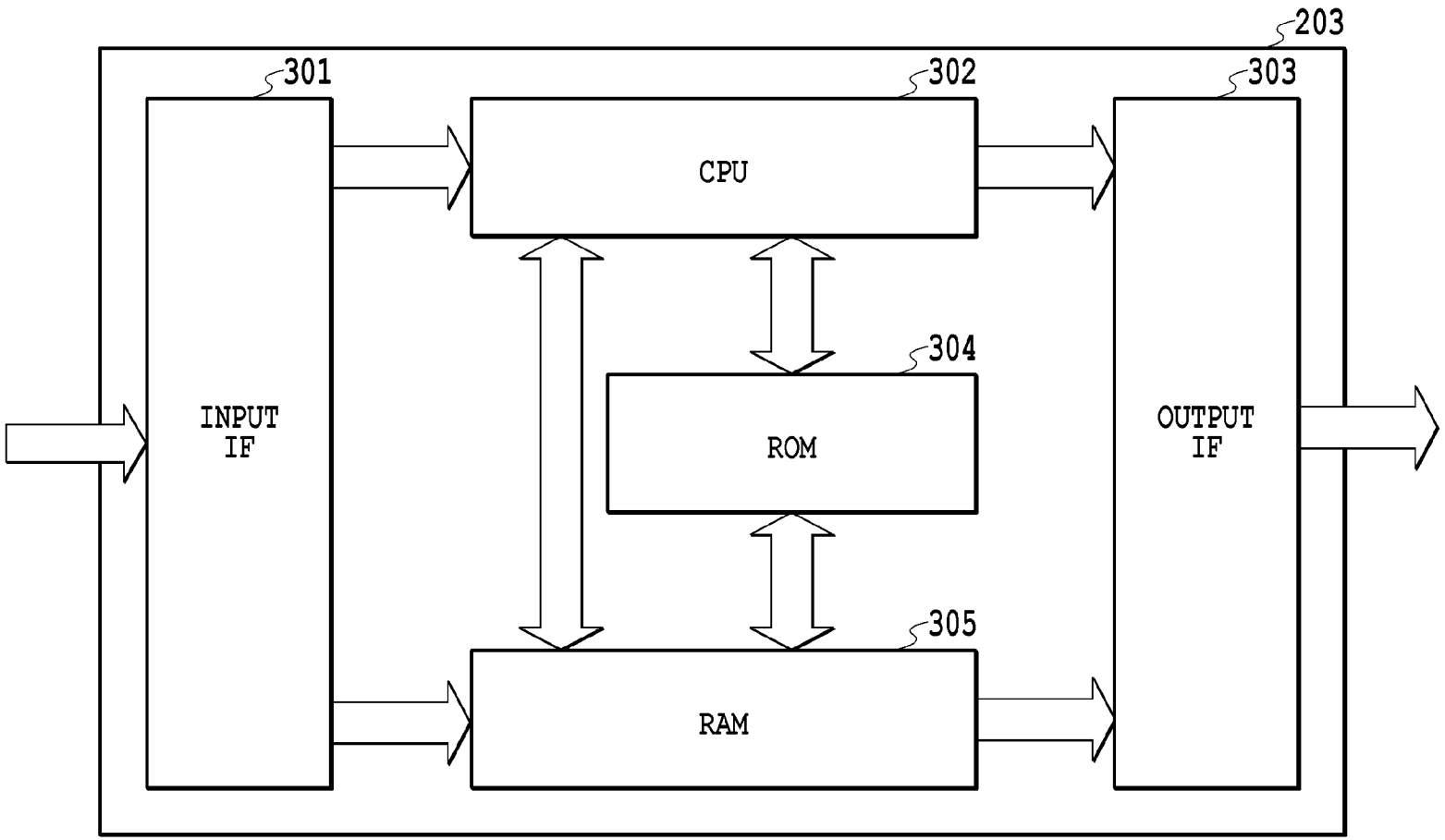
FIG. 3 is a block diagram illustrating the configuration of a control circuit unit.

FIG. 3 is a block diagram illustrating the configuration of the control circuit unit 203 illustrated in FIG. 2. The control circuit unit 203 is configured to include an input interface 301, a CPU 302, an output interface 303, a ROM 304, and a RAM 305. The input interface (IF) 301 receives input of image data and control signals for driving the recording head 201 from an information processing apparatus or the like outside the printer 114. The input interface 301 transmits the image data and control signals to the RAM 305 and the CPU 302. In this case, the CPU 302 executes a control program stored in the ROM 304 as a nonvolatile memory to perform signal processing on the image data. The signal-processed image data is output as print data together with the control signal from the output interface 303. The recording head 201 is driven by the output print data and control signal, and an image is recorded on the sheet 204 or the medium on the tray.

Figure 4C:
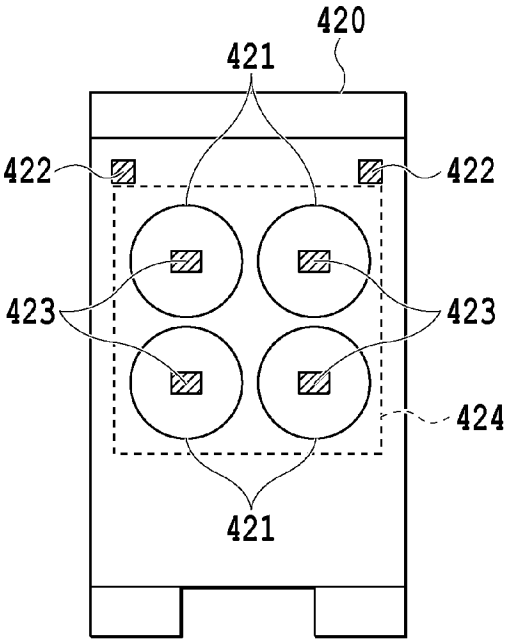
FIGS. 4A to 4C are diagrams illustrating examples of trays, respectively.
Figure 4B:
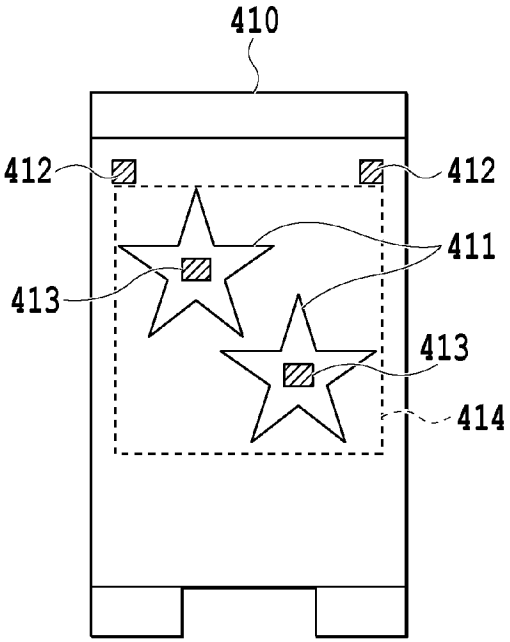
Figure 4A:
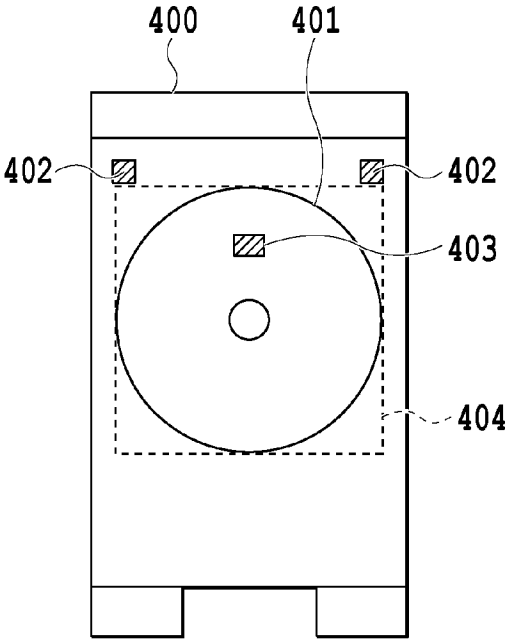

FIGS. 4A to 4C are diagrams illustrating examples of trays that may be used in the printer 114 according to the embodiment. The tray illustrated in FIG. 4A is an original tray generated for use in the printer 114 according to the embodiment. This tray is an example of a tray dedicated to a general disc label having a circular recording area such as a CD and a DVD. The tray 400 is provided with a slot area 401 into which a disc medium such as a CD or a DVD can be fitted, a reflecting plate 402 for detecting the position of the tray, and a reflecting plate 403 for determining whether or not the disc medium is set in the tray. The reflecting plate 402 is made of a member having a relatively high reflection performance. Regularly reflected light from the reflecting plate is measured by using an optical sensor, and it is possible to detect whether or not a medium exists on the basis of the measured value. The recordable area 404 indicated by a broken line is a recordable area in the tray 400, and in this embodiment, the recordable area has a size of 120 mm×120 mm.

On the other hand, FIG. 4B illustrates a tray which is generated in the same manner as the tray 400 and may be used in the printer 114. Namely, the tray illustrated in FIG. 4B is generated so as to be recorded by the recording head 201 by being conveyed along the conveying path of the tray by the printer 114. For example, the standard of rigidity of the tray, the standard of the tray size, the specification of the material of the reflecting plate, and the like are the same as those of the original tray 400 illustrated in FIG. 4A. A star-type medium tray 410 illustrated in FIG. 4B is provided with a slot area 411 into which a medium can be fitted, a reflecting plate 412 for detecting the position of the tray, and a reflecting plate 413 for determining whether or not a medium is set in the tray. In addition, similarly to the recordable area 404 of the disc tray, a recordable area 414 indicated by a broken line has a size of 120 mm×120 mm. Similarly to the tray illustrated in FIG. 4B, a ring-type medium tray 420 illustrated in FIG. 4C is a tray which is generated similarly to the tray 400 and may be used by the printer 114. The tray 420 is also provided with a slot area 421 into which a medium can be fitted, a reflecting plate 422 for detecting the position of the tray, and a reflecting plate 423 for determining whether or not a medium is set in the tray. In addition, similarly to the recordable area 404 of the disc tray, a recordable area 424 indicated by a broken line has a size of 120 mm×120 mm. In the above tray configuration, in the tray illustrated in FIG. 4A, one medium can be arranged, and the trays illustrated in FIGS. 4B and 4C, two or four media can be arranged, respectively.

[System Configuration]

Figure 5:
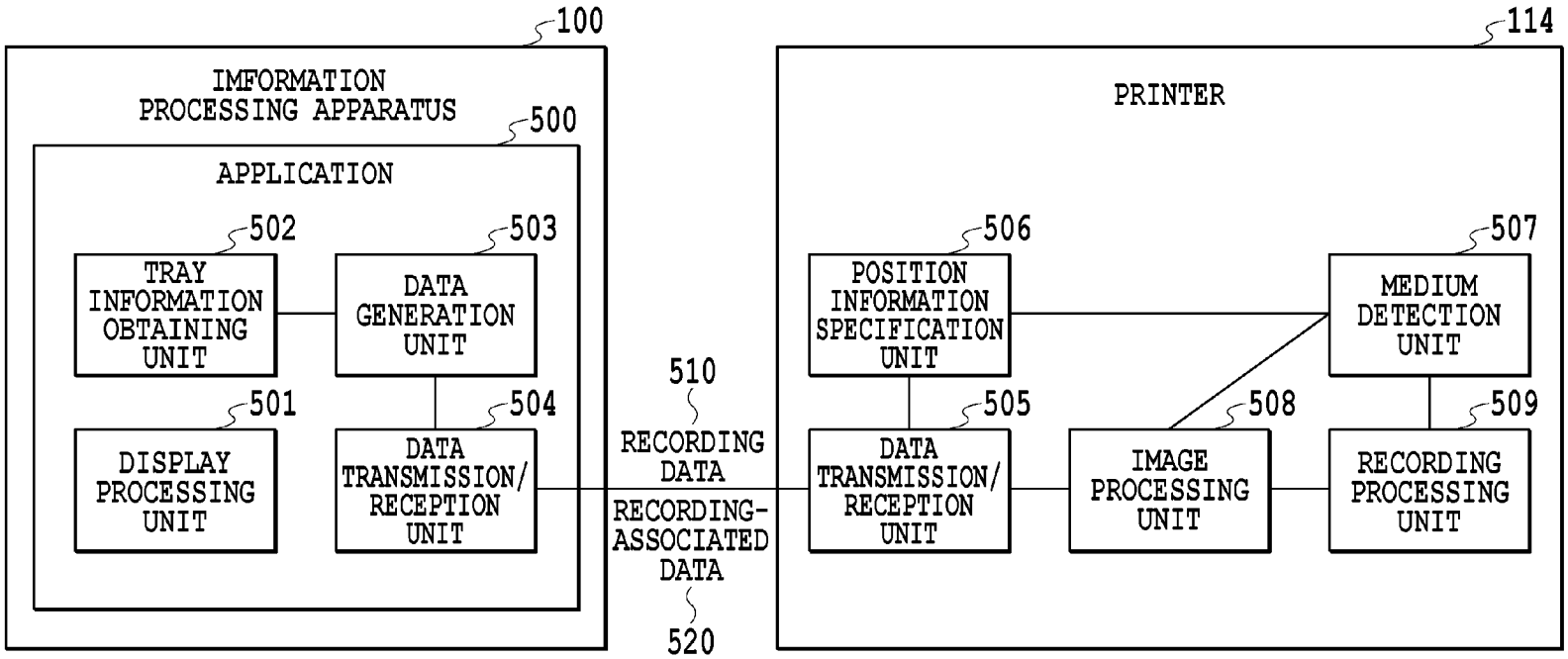
FIG. 5 is a block diagram illustrating a configuration of a recording system including an application and a printer.

FIG. 5 is a block diagram illustrating a configuration of a recording system including an application 500 operating on an information processing apparatus 100 and a printer 114. A program of the application 500 is stored in the ROM 103 or the secondary storage device 105 illustrated in FIG. 1 and is executed by the CPU 102. The application 500 has a function of generating a content desired to be recorded by using a tray and transmitting recorded data to the printer 114. In addition, as described in detail later, the application also adapts to recording on media fitted in various trays as illustrated in FIGS. 4A to 4C. In other words, the application retains information on an arbitrary tray in advance, and the printer 114 does not retain the information on the arbitrary tray.

Each of components 501 to 504 included in the application 500 illustrated in FIG. 5 has a function of using the information processing apparatus 100 to transmit recording data 510 and recording-associated data 520 to the printer 114 and to execute recording by using the tray. Namely, a display processing unit 501 performs a process of displaying image information, character information, and the like used for the recording process on the display 106 of the information processing apparatus 100. In addition, the display processing unit also has a function of displaying images associated with the user interface (UI) such as buttons for selecting images, characters, or the like, a list of recording settings, a list of tray settings described later, and the like.

Figure 6:
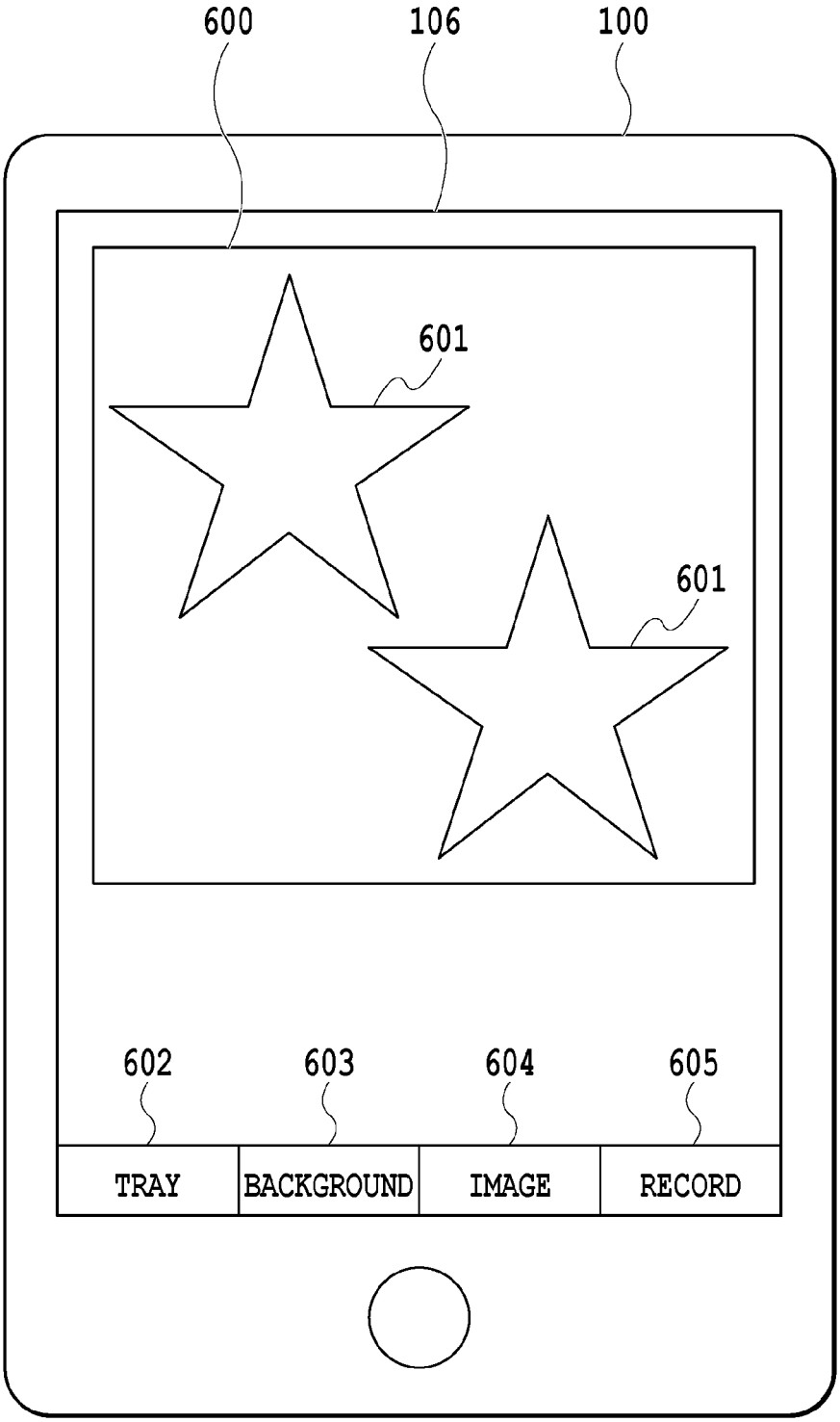
FIG. 6 is a diagram illustrating a UI screen of the application.

FIG. 6 is a diagram illustrating a UI screen of the application 500 operating on the information processing apparatus 100. A tray selection button 602, a background selection button 603, an image selection button 604, and a record button 605 are displayed on the display 106 of the information processing apparatus 100. In the content editing area 600, a content that is being edited is displayed. Slots having the same shape and position as the slots of the tray selected at that time are displayed in the slots 601.

Figure 7:
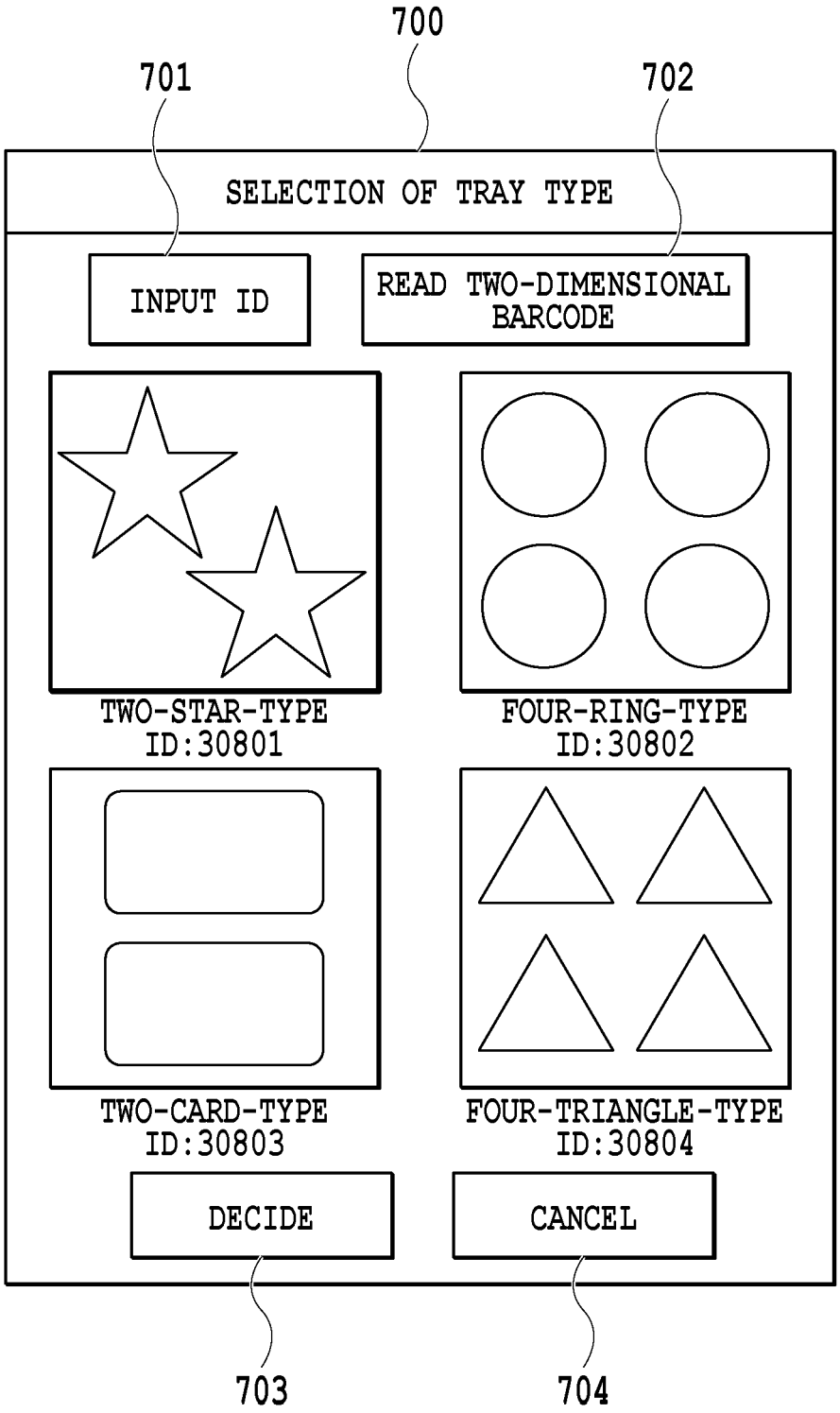
FIG. 7 is a diagram illustrating a tray type selection dialogue according to the application.

Referring to FIG. 5 again, a tray information obtaining unit 502 obtains information on the selected tray according to user instruction or the like. In FIG. 6, in a case where the tray selection button 602 is selected, the display processing unit 501 displays a tray type selection dialogue 700 illustrated in FIG. 7. Namely, as illustrated in FIG. 7, a selectable tray is displayed on the display 106. In FIG. 7, in a case where an ID input button 701 is selected, an ID input screen (not shown) is displayed, so that the user can directly input an ID of a tray as a numerical value. For example, the ID of the tray is written in the package of the tray or on the tray body, and there is a mode where the user inputs the ID using an application. In a case where a two-dimensional barcode read button 702 is selected, a barcode reading screen is displayed, and a tray information obtaining unit 502 obtains ID information of the tray from the two-dimensional barcode. Then, the display processing unit 501 sets the tray corresponding to the ID obtained by the tray information obtaining unit 502 to the selected state. As a two-dimensional barcode, there may be exemplified a QR code (registered trademark). In a case where a decide button 703 is selected, the display processing unit 501 closes the dialogue 700 and displays the selected tray in the content editing area 600. In a case where a cancel button 704 is selected, the display processing unit 501 closes the dialogue 700 and returns to the editing screen. In FIG. 6, in a case where a background selection button 603 is selected, the display processing unit 501 opens a dialogue allowing selection of the background of a slot and selects the background. In a case where the image selection button 604 is selected, the display processing unit 501 opens an image selection dialogue and accepts selection of an image stored in the information processing apparatus 100. In addition, in this embodiment, images are selected from the image selection dialogue, but an internal imaging device 112 may be separately activated to use the captured image. The selected image is displayed in the content editing area and can be enlarged, reduced, rotated, or moved by touch, swipe, or pinch operation. In accordance with the above selection or the like, the application can obtain the information of the selected tray.

In FIG. 5, a data generation unit 503 generates data necessary for recording in the printer 114. In FIG. 6, in a case where a record button 605 is selected, the display processing unit 501 opens a recording setting dialogue. Next, various settings necessary for recording such as printer selection and borderless recording setting are performed by the user. In response to the setting, the data generation unit 503 generates data necessary for recording.

Figure 8:
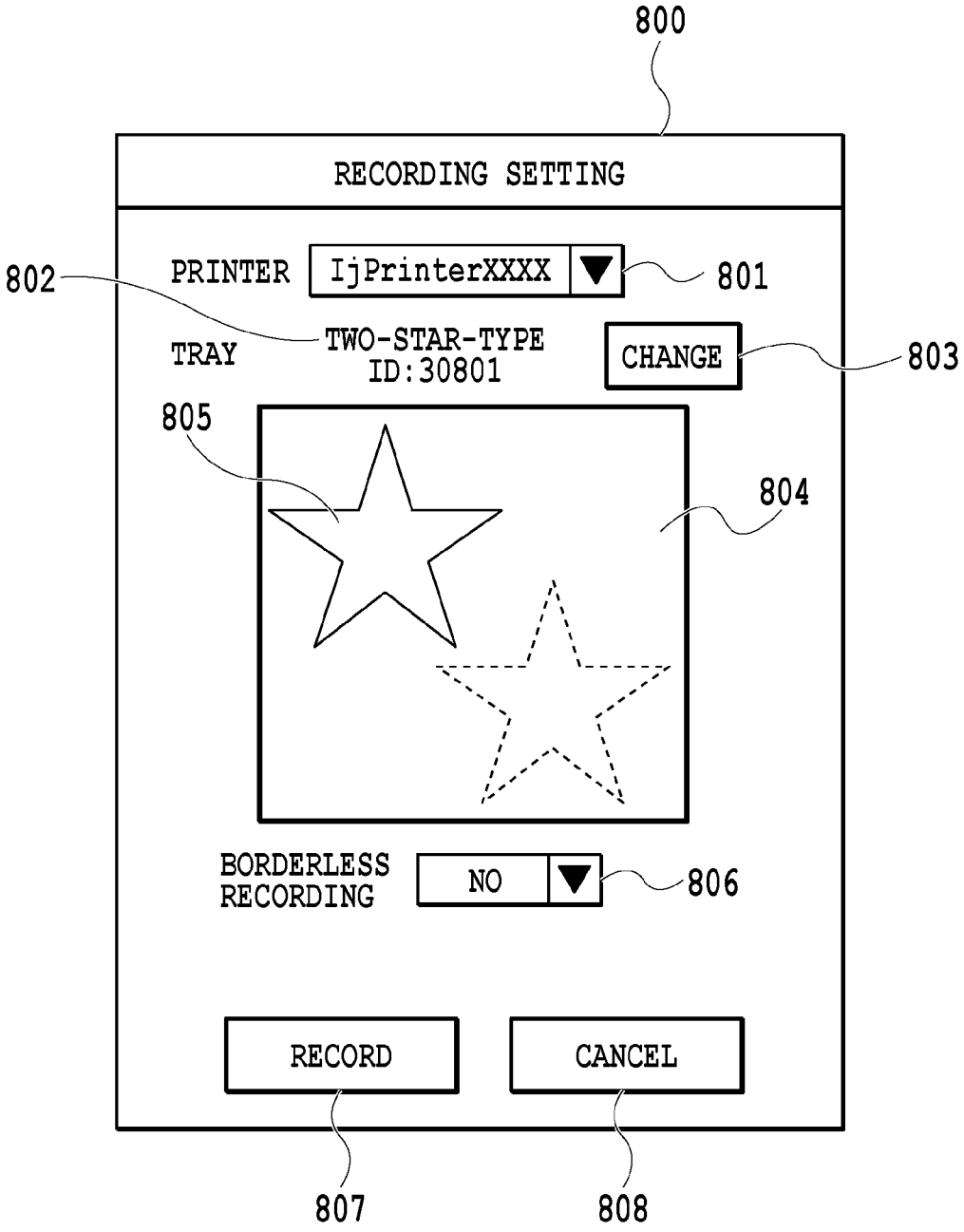
FIG. 8 is a diagram illustrating a recording setting dialogue according to the application.

FIG. 8 is a diagram illustrating the recording setting dialogue described above. In the recording setting dialogue 800, selection of a printer, checking and changing of tray type, preview displaying of contents, designation of a recording target slot, and setting of borderless recording can be performed. In a case where a printer selection list 801 is selected, the display processing unit 501 displays a list of usable printers. The user can select a printer from the displayed list. A used tray-type display section 802 displays the type of the selected tray and the tray ID. In a case where a change button 803 is selected, the display processing unit 501 displays the tray type selection dialogue 700 illustrated in FIG. 7. The user can select the tray by using the tray type selection dialogue 700. In a case where the tray is changed, since the content being edited is affected, the tray is changed after it is notified to the user that the content is affected. A preview of the recorded content is displayed in a preview area 804. Herein, by tapping the recording target slot 805, it is possible to switch between the recording target and the non-recording target. In a case where the non-recording target is selected, the display processing unit 501 changes display of the recording target by displaying the edge of the slot with a broken line and not displaying the content in the slot. In a borderless recording setting 806, setting with a border or without a border is performed. In a case where the record button 807 is pushed, processing for recording in the printer 114 is started. In a case where the cancel button 808 is pushed, the process returns to the previous screen without executing recording. In addition, information associated with the recording setting of the printer may be stored in advance in the information processing apparatus or may be downloaded from the server 116 or the printer 114 via the network.

In a case where the record button 807 is selected, as a process for recording in the printer 114, the data generation unit 503 (FIG. 5) executes rendering of the recording content to generate image data. After the rendering, the data generation unit 503 generates a print command according to the communication protocol of the printer 114 on the basis of the recording setting information set in the recording setting dialogue 800. The data generation unit 503 adds the print command to the image data and generates recording data.

A data transmission/reception unit 504 (FIG. 5) on the information processing apparatus 100 side transmits the recording data 510 and the recording-associated data 520 to the printer 114. The recording-associated data 520 is additional data not directly associated with the recorded data. In this embodiment, data of information for detecting the medium in the tray is included in the recording-associated data. Specifically, the recording-associated data includes, for example, a tray name, the number of slots in the tray, and medium detection position information (detection position information of the recording medium; X coordinate, Y coordinate) for each slot. The coordinate information in the medium detection position information coordinates with the origin at the upper left of a recordable area of 120 mm×120 mm.

FIG. 9 is a diagram illustrating recording-associated data according to this embodiment. As illustrated in FIG. 9, the recording-associated data is data defined for each tray such as "tray ID", "tray name (type)", "number of slots", "X coordinate of medium detection position", and "Y coordinate of medium detection position". Such a recording-associated data is retained in the application in advance as a table data, for example, in a form where the data is in one-to-one correspondence to the type of tray. In this embodiment, the recording-associated data includes parameters (each data illustrated in FIG. 9) associated with the medium detection. However, in addition to the parameters, the data may include parameters associated with conveyance of the tray (for example, the pressure and conveying amount of a conveying roller). In addition, the detection position information of the medium as the recording-associated data in an array may be configured to be stored and transmitted, and the number of slots may be configured to be determined from the number of arrays on the receiving side.

The data transmission is performed by using a known wireless Wi-Fi technology for connecting the information processing apparatus 100 and the printer 114, for example, through radio waves. As a data transmission method, other known methods may be used. For example, the information processing apparatus 100 and the printer are connected through a USB port. On the information processing apparatus 100 side, a printer driver converts data into raster data which is recordable by a printer. This recordable raster data is transmitted to the printer through the USB port. In a method, the printer side may convert the received raster data into recordable data and may perform recording.

Details of processes from rendering of the recording content by the data generation unit 503 to transmission of the recording data to the printer 114 by the data transmission/reception unit 504 illustrated in FIG. 5 will be described below.

The data generation unit 503 generates recording data on the basis of the content displayed in the content editing area 600 illustrated in FIG. 6. The content used for recording is described in a web standard language (hyper text markup language (HTML), CSS, JavaScript (registered trademark), or the like.). In this embodiment, it is assumed that content is described in scalable vector graphics (SVG) which is one of graphic notation methods in HTML. However, the invention is not limited to the embodiment. But for example, Canvas used for describing graphics in HTML may be used.

A description example by SVG illustrated below describes the content where one image and one stamp are arranged on the four-ring-type trays. In addition, the description examples are provided for the purpose of illustrating the outline, and detailed description of the setting is omitted.

SVG Description Examples

```
(a) 01: <svg xmlns="http://www.w3.org/2000/svg" xmlns:xlink="http://www.w3.org/1999/xlink"
        width="1000" height="1000" viewBox="0 0 1000 1000">
    02:   <defs>
    03:     <clipPath id="mask0" maskUnits="userSpaceOnUse" clip-rule="evenodd" x="0" y="0"
            width="1000" height="1000">
    04:       <path d="10 0 v 1000 h 1000 y −1000 h −1000 z
    05:       150,250 A200,200 0 1,0 450,250 A200,200 0 1,0 50,250
    06:       1550,250 A200,200 0 1,0 950,250 A200,200 0 1,0 550,250
    07:       150,750 A200,200 0 1,0 450,750 A200,200 0 1,0 50,750
    08:       1550,750 A200,200 0 1,0 950,750 A200,200 0 1,0 550,750" />
    09:     </clipPath>
    10:   </defs>
    11:
    12:   <image width="200" height="300" x="150" y="100" xl ink:href="image.jpg"></image>
    13:   <image width="200" height="300" x="650" y="100" xl ink:href="stamp.png"></image>
    14:
    15:   <rect id="maskArea0" clip-path="url(lmask0)" fill-opacity="0.5" x="0" y="0" width="1000"
          height="1000" fill="lightgray"/>
    16:   <circle cx="250" cy="250" r="200" id="circlel" stroke="gray" stroke-width="3" fill="none"></circle>
    17:   <circle cx="750" cy="250" r="200" id="circlel" stroke="gray" stroke-width="3" fill="none"></circle>
    18:   <circle"cx="250" cy="750" r="200" id="circlel" stroke="gray" stroke-width="3" fill="none"></circle
    19:   <circle"cx="750" cy="750" r="200" id="circlel" stroke="gray" stroke-width="3" fill="none"></circle
    20: </svg>
(b) 01: <svg xmlns="http://www.w3.org/2000/svg" xmlns:xlick="http://www.w3.org/1999/xlink"
        width="2834" height="2834" viewBox="0 0 1000 1000">
    02:   <defs>
    03:     <clipPath id="mask0" maskUnits="userSpaceOnUse" clip-rule="evenodd" x="0" y="0"
            width="1000" height="1000">
    04:       <path d="10 0 v 1000 h 1000 v −1000 h −1000 z
    05:       150,250 A200,200 0 1,0 450,250 A200,200 0 1,0 50,250
    06:       1550,250 A200,200 0 1,0 950,250 A200,200 0 1,0 550,250
    07:       150,750 A200,200 0 1,0 450,750 A200,200 0 1,0 50,750
    08:       1550,750 A200,200 0 1,0 950,750 A200,200 0 1,0 550,750" />
    09:     </clipPath>
    10:   </defs>
    11:
    12:   <image width="200" height="300" x="150" y="100" xl ink:href="image.jpg"></image>
    13:   <image width="200" height="300" x="650" y="100" xl ink:href="stamp.png"></image>
    14:
    15:   <rect id="maskArea0" clip-path="url(lmask0)" fill-opacity="1" x="0" y="0" width="1000"
          height="1000" fill="white"/>
    16:   <circle cx="250" cy="250" r="200" id="circlel" fill="none"></circle
    17:   <circle cx="750" cy="250" r="200" id="circlel" fill="none"></circle
    18:   <circle cx="250" cy="750" r="200" id="circlel" fill="white"></circle
    19:   <circle cx="750" cy="750" r="200" id="circlel" fill="none"></circle
    20: </svg>
```

Figure 10:
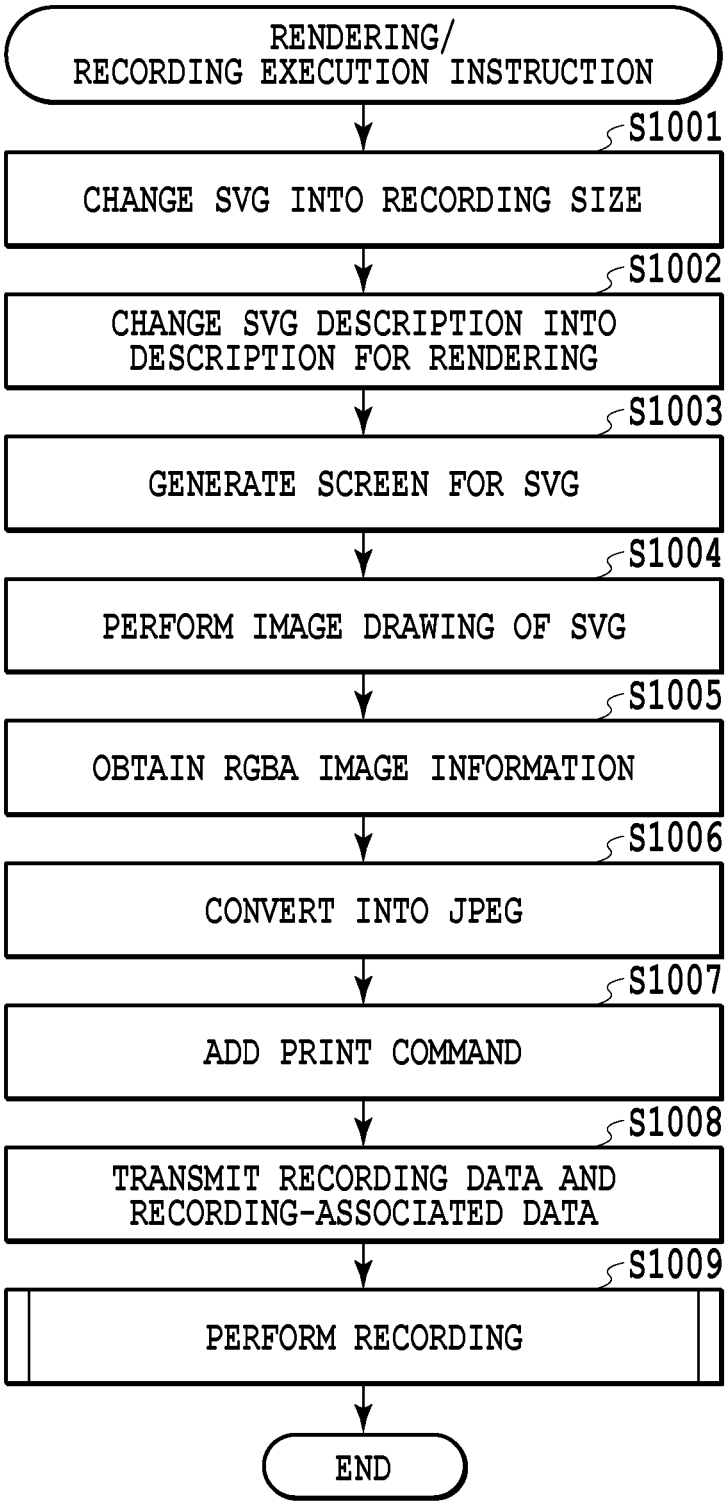
FIG. 10 is a flowchart illustrating a rendering/recording execution instruction process.

An SVG description example (a) illustrates the description of the content by the SVG before rendering described later in FIG. 10. An SVG description example (b) illustrates the description of content after the description of the SVG size or the like is changed in the rendering process. In the SVG description examples (a) and (b), in Line 01 on the left side, it is described that the content is described by SVG, which defines the size of SVG. Lines 02 to 10 define the slot shape of the content, and in four-ring-type trays of this embodiment, four circles are arranged in the recordable area. Line 12 is a description about the image added to the content, and Line 13 is a description on the stamp added to the content. Line 15 is a description about a non-recordable area outside the slot of the content, and the area is set to a gray color for UI display. Lines 16 to 19 define the lines that draw edges of the slots, and the edges are also described for UI display.

Next, the processes from the completion of the rendering to the obtaining of the rendering image will be described. FIG. 10 is a flowchart illustrating a rendering/recording execution instruction process by the application 500 operating in the information processing apparatus 100. In addition, the process is a process in which the CPU 102 (FIG. 1) of the information processing apparatus 100 reads a program stored in a memory such as the ROM 103 and executes in accordance with the program. First, in step S1001, the data generation unit 503 obtains output resolution from the printer. In a case where the output resolution is 600 dpi, the output size becomes 2834 px (pixels)×2834 px from the recordable area size of the tray of 120 mm×120 mm. In this case, a portion of the SVG of the content is rewritten for recording. The width and height of the SVG are changed according to the image size to be transmitted to the printer, and the width and height of Line 01 illustrated in the SVG description example (a) are changed to "2834" (refer to the SVG description example (b)).

Next, in step S1002, the data generation unit 503 deletes or changes a description not necessary for rendering from the content of the SVG description. First, fill-opacity="0.5" in the SVG description example (a) in the description on the non-recordable area in Line 15 of the above SVG description example (a) is changed to "1" (SVG description example (b)), and fill="lightgray" in the SVG description example (a) is changed to "white" (SVG description example (b)). As a result, the area outside the slot becomes white, so that ink can be prevented from being ejected outside the slot retaining the medium in a case of recording the medium. Since the lines drawing the edges of the slots of Lines 16 to 19 in the SVG description example (a) are not necessary for rendering, the description of stroke="gray" and stroke-width="3" is deleted (refer to the SVG description example (b)). In the recording setting dialogue 800, in a case where the slot 805 is set as a non-recording target, the data generation unit 503 changes the description of the corresponding slot. For example, if the lower left slot is a non-recording target, fill="none" in Line 18 in the SVG description example (a) is changed to "white" (refer to the SVG description example (b)). As a result, the area inside of the slot becomes white, so that recording can be prevented from being performed on the image or the stamp arranged in the slot.

Next, in step S1003, the data generation unit 503 requests the OS (not shown) of the information processing apparatus 100 to generate a screen. According to the SVG description example, the OS obtains an area of 2834 px×2834 px from the program content of the SVG description. Then, the OS executes screen (2834 px×2834 px) generation for SVG. Information on the size of the SVG is stored not in the SVG itself but in the application 500. In addition, the generated screen is generated as an off screen. The off screen denotes a screen that is not displayed on the UI. Then, in step S1004, the data generation unit 503 requests the OS to draw the content of the SVG on the screen generated in step S1003. In response to this request, the OS loads information of the SVG. In a case where the loading of the information of the SVG is completed, the data generation unit 503 receives a notice of load completion from the OS. For this notice, a standard function included in OS can be used. For example, in a case of an Objective-C language used for generating an iOS application, a webViewDidFinishLoad function or the like is available. In addition, in a case of a Java language used for generating an Android application, an onPageFInished function is available. Next, in step S1005, the data generation unit 503 requests the OS to transmit image information. Herein, the image information is the RGBA data drawn on an off screen in step S1004. Namely, the screen capture is executed. In response to a request from the data generation unit 503, the OS performs the screen capture of the displayed screen and transmits obtained RGBA information to the data generation unit 503.

In step S1006, the data generation unit 503 converts the RGBA data obtained as described above into a JPEG image. Herein, the RGBA data transmitted from the OS to the data generation unit 503 in step S1005 includes information of A (transparency) unnecessary for recording. Therefore, JPEG conversion is executed except for this information. In addition, in this embodiment, the image data is converted into JPEG. However, data converted into a PDF format by using a known PDF (Portable Document Format) technology may be used as an image data.

Next, in step S1007, the data generation unit 503 adds a print command for transmission to the printer to the JPEG image generated in step S1006. Herein, the data to be added to the JPEG image is generated on the basis of the information of the printer setting. In addition, a command for controlling the printer 114 may be added as necessary. In this embodiment, information on the tray slots is added as a command.

The following are examples of print commands for print data, and the examples are described in XML format. As described below, the recording data is configured with image data and recording setting information.

XML Description Examples

```
(a) 01 : <?xml version=" 1.0" ?>
    02 : <content>
    03 :     <size>DVD</size>
    04 :     <media>NORMAL PAPER</media>
    05 :     <quality>HIGH</quality>
    06 :     <imageData>
    07 :         <width>2834</width>
    08 :         <height>2834</height>
```

-continued

```
    09 :        <format>JPEG</format>
    10 :        <data> JPEG のデータ </data>
    11 :    </imageData>
    12 : </content>
(b) 01: <?xml version=" 1.0" ?>
    02: <discTray>
    03:     <trayID>30802</trayID>
    04:     <trayName>circle4</trayName>
    05:     <slotNum>4</slotNum>
    06:     <slotInfo>
    07:       <slot x="6" y="6" width="48" height="48" cx="30" cy="30"></slot>
    08:       <slot x="66" y="6" width="48" height="48" cx="90" cy="30"></slot>
    09:       <slot x="6" y="66" width="48" height="48" cx="30" cy="90"></slot>
    10:       <slot x="66" y="66" width="48" height="48" cx="90" cy="90"></slot>
    11:     </slotInfo>
    12: </discTray>
(c)
    01: <?xml version=" 1.0" ?>
    02: <discTray>
    03:     <trayID>30802</trayID>
    04:     <trayName>circle4</trayName>
    05:     <slotNum>4</slotNum>
    06:     <slotInfo>
    07:       <slot x="6" y="6" width="48" height="48" cx="30" cy="30"></slot>
    08:       <slot x="66" y="6" width="48" height="48" cx="90" cy="30"></slot>
    09:       <slot x="6" y="66" width="48" height="48" cx="30" cy="90"
              ditection="false"></slot>
    10:       <slot x="66" y="66" width="48" height="48" cx="90" cy="90"></slot>
    11:     </slotInfo>
    12: </discTray>
```

The XML description example (a) illustrates print commands for print data. In Lines 03 to 05 indicated by the numbers on the left side, settings for the printer "Record in high quality mode on DVD-sized plain paper" are described. In addition, in Lines 07 to 09, it is described that the recording data is "JPEG data with a width of 2834 and a height of 2834". Actual JPEG data is inserted in Line 10. The printer 114 performs recording by receiving the above-described command together with image data.

The XML description example (b) illustrates print commands for recording-associated data. Information on trays such as tray ID, tray name, number of slots, and the like is described in Lines 03 to 05. In addition, information on the slots is described in Lines 07 to 10. For example, the first slot is defined as "cx=30, cy=30", which denotes the X coordinate and the Y coordinate of the medium detection position. In this embodiment, as described later with reference to FIG. 11, the printer 114 analyzes this definition and performs medium detection at coordinates designated at the time of medium detection.

The XML description example (c) illustrates another description example of the recording-associated information described later.

Referring to FIG. 10 again, following the addition of the command in step S1007, the data transmission/reception unit 504 requests the OS to transmit the recording data and the recording-associated data in step S1008. The OS transmits the data received from the application to the printer 114. As illustrated in step S1009, the printer 114 starts executing the recording process on the basis of the data received from the information processing apparatus 100.

Figure 11:
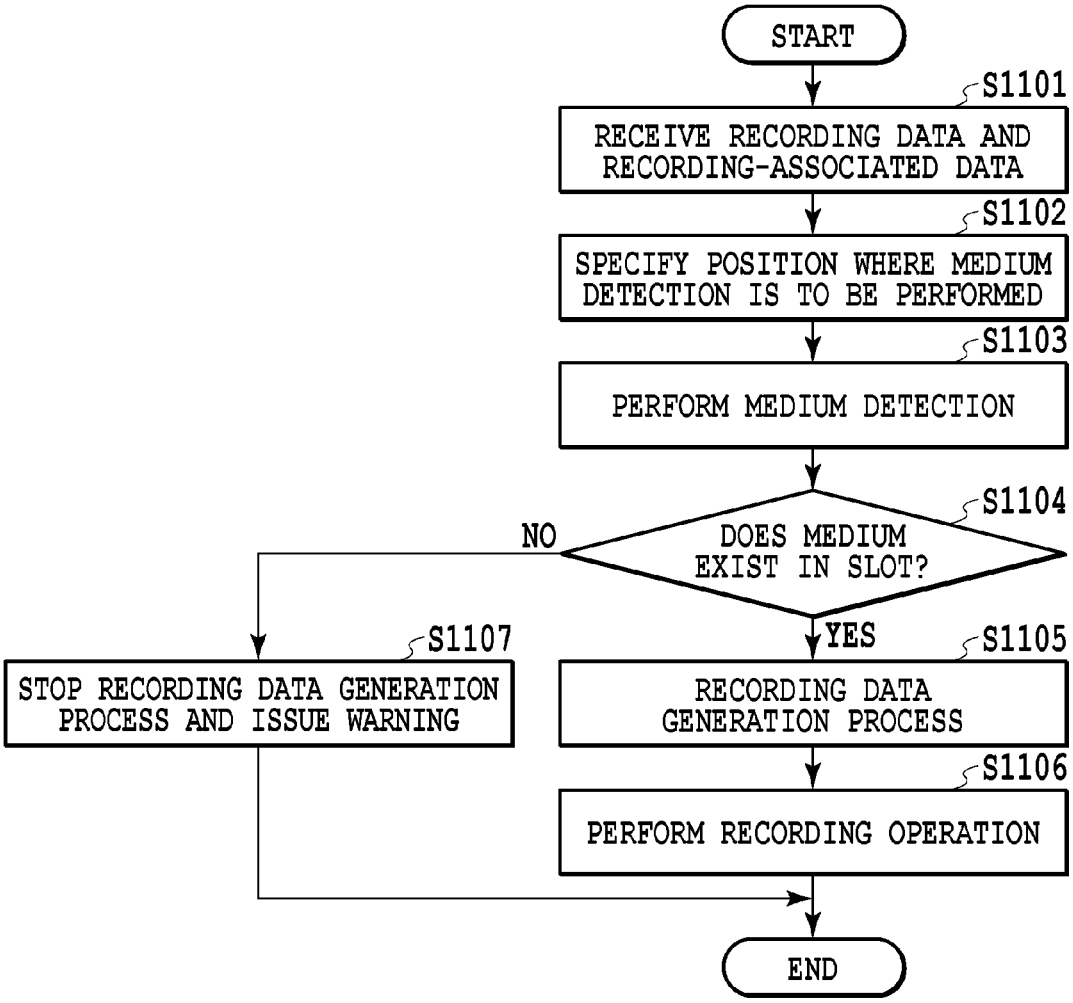
FIG. 11 is a flowchart illustrating a recording process for a medium on a tray.

FIG. 11 is a flowchart illustrating the recording process for a medium on the tray in the printer according to the first embodiment of the invention. This process is a process in which the CPU 302 (FIG. 3) in the control circuit unit 203 of the printer 114 reads a program stored in a memory such as the ROM 304 and executes in accordance with the program. If the process is started, first, in step S1101, a data transmission/reception unit 505 (FIG. 5) of the printer 114 receives the recording data 510 and the recording-associated data 520 transmitted from the information processing apparatus 100. Then, the data transmission/reception unit 505 transmits the recording setting information such as the paper size and paper type obtained by analyzing the recording command included in the received recording data 510 to an image processing unit 508. In addition, the data transmission/reception unit 505 decodes the JPEG file included in the recording data, converts the decoded JPEG file into image data, and transmits the converted image data to the image processing unit 508. In addition, the data transmission/reception unit 505 transmits the recording-associated data 520 to a position information specification unit 506.

Next, in step S1102, the position information specification unit 506 specifies a position for detecting the medium from the recording-associated data 520 transmitted from the data transmission/reception unit 505. Specifically, by analyzing the command illustrated in the XML description example (b), the values of the X coordinate of medium detection position and the Y coordinate of medium detection position are obtained. The medium detection position is information indicating at which positions of the tray the reflecting plates 403, 413, and 423 in FIGS. 4A to 4C exist. This information is transmitted to a medium detection unit 507. The medium detection is basically performed for all slots in the tray. However, in the recording setting dialogue 800, in a case where there is a slot that is set as a non-recording target, it is possible to prevent the medium from being detected in the slot. This is because it is not necessary to perform detection since the image of the corresponding slot is erased at the time of rendering. In that case, for example, by adding an attribute to the slot information of the command and analyzing the attribute, it is unnecessary to allow detection to be performed. For example, at the time of generating a print command, the data generation unit 503 adds detection="false" to the slot not to be detected as illustrated in Line 09 of the XML description example (c). At the time of specifying the position information, in a case where there is a slot of which attribute is set to be false, the slot is not detected.

Next, in step S1103, the medium detection unit 507 performs medium detection in the slot by using an optical sensor (not shown) attached to a carriage (not shown) illustrated in FIG. 2. The detection is performed by an optical sensor using a known method. The optical sensor has a light emitting portion and a light receiving portion. The positions of X coordinates and Y coordinates received from the position information specification unit 506 are the positions of the reflecting plates 403, 413, and 423 illustrated in FIGS. 4A to 4C. In a case where no medium is arranged, the optical sensor receives the reflected light from the reflecting plates 403, 413, and 423 at the positions of X coordinates and Y coordinates in the slot. On the other hand, in a case where a medium is arranged, the optical sensor cannot receive the reflected light from the reflecting plates 403, 413, and 423 in the slot. The reflecting plates 403, 413, and 423 made of members having high reflection performance are provided at the positions of X coordinates and Y coordinates in the slot of the tray, and by measuring the reflected light of the reflecting plates by using the optical sensor, it can be detected whether or not a medium exists. In step S1104, the medium detection unit 507 determines whether or not a medium is arranged in the slot on the basis of the above detection. Namely, it is determined whether or not a recording medium is arranged in the slot corresponding to the medium detection positions specified in step S1102. Herein, if it is determined that no medium is arranged in the slot where the medium is to be arranged, the medium detection unit 507 instructs a recording processing unit 509 to stop the process for generating the recording data in step S1107. After the recording process is stopped by the recording processing unit 509, for example, the data transmission/reception unit 505 transmits stop information of the recording process to the information processing apparatus 100. In response to the information, the information processing apparatus 100 displays a warning to the user to the display processing unit 501. Therefore, recording can be prevented from being performed on the slot where no medium is arranged.

In a case where it is determined in step S1104 that the medium is arranged, the medium detection unit 507 instructs the image processing unit 508 and the recording processing unit 509 to continue performing the process for generating the recording data. In step S1105, first, the image processing unit 508 performs a process of converting an input image data to an output image data on the basis of the recording setting information and the input image data received from the data transmission/reception unit 505. For example, it is assumed that the input image data received from the data transmission/reception unit 505 is a small image having a size of 1000 pixels×1000 pixels. In this case, if the paper size is 120×120 mm in DVD size and the recording resolution is 600 dpi as recording setting information, the recording image data has a size of 2834×2834 pixels. For this reason, the image processing unit 508 scales the input image data (1000×1000 pixels) received from the data transmission/reception unit 505 into the output image data (2834×2834 pixels) so as to match the paper size. As the scaling process, there may be exemplified nearest neighbor, bilinear, bicubic methods, and the like. The scaling process may be selected in consideration of processing characteristics and processing speed. In a case where the recording setting information includes correction processing information, the image processing unit 508 executes an image correction process on the input image data or the output image data. As the image correction, there may be exemplified various methods such as brightness adjustment, contrast adjustment, color balance adjustment, backlight correction or red eye correction for photograph recording, and the like. In this embodiment, since the correction processing information is not included in the setting in the recording setting dialogue 800, the image correction process is not executed. If the scaling process is ended, the image processing unit 508 transmits the output image data to the recording processing unit 509.

The recording processing unit 509 converts (color-decomposes) the output image data received from the image processing unit 508 into color data of ink used in the printer. As a method of converting into ink color data, there may be used a known color conversion process for converting an image format (RGB) used for screen display into ink color (CMYK) for recording. For example, the ink used in the printer 114 has four colors of cyan (C), magenta (M), yellow (Y), and black (K). Accordingly, the recording processing unit 509 converts data of three colors of red (R), green (G), and blue (B) outputted by the image processing unit 508 into data of four color inks of C, M, Y, and K. The recording processing unit 509 performs interpolation calculation on the data obtained from a color decomposition table to generate the data of ink colors C, M, Y, and K. Furthermore, the recording processing unit 509 converts the ink color data into the recording output data by performing image processing such as output tone correction and half-toning using image processing parameters of a lookup table or the like. The converted recording output data is transmitted to the control circuit unit 203 illustrated in FIG. 2, and the image is recorded by ejecting ink on the medium arranged in the tray (S1106).

As described above, according to this embodiment, even in a case of using a tray with a slot having an arbitrary shape which is not provided in a printer, it is possible to determine whether or not a medium is arranged in the slot. Therefore, for example, it is possible to solve the problem in that ink is ejected on a slot where no medium is arranged and, thus, the slot is contaminated with the ink. In addition, the contamination with ink is an example, and according to this embodiment, it is possible to obtain an effect of reducing an unnecessary printing process.

Second Embodiment

In the first embodiment described above, as illustrated in FIGS. 4A to 4C, the reflecting plates 403, 413, and 423 are provided for determining whether or not a medium exists in the slot of the tray. However, the detection may be configured to be performed by other reflecting plates. For example, a specific pattern which can be measured by a sensor may be provided at the position of the slot in the tray.

In addition, in a case where a difference in color between the tray and the medium to be arranged is large, it may be determined whether or not a medium exists by using the difference in color. In that case, it is not necessary to use a special member at the position of the reflecting plate. For example, in a case where there is such a large difference in color that the tray is black and the medium is white and it can be determined whether or not a medium exists by measuring a reflection density of the medium detection position in the slot with the optical sensor. In this manner, it may also be determined whether or not a medium exists on the basis of differences in optical characteristics measured by the optical sensor.

Third Embodiment

In the first embodiment, on the basis of the recording-associated data for specifying the detection position of the medium, it is determined which slot is used for determination of whether or not a medium exists. However, in addition to the recording-associated data, on the basis of the recording data, it is also possible to determine a slot that is not used for determination of whether or not a medium exists. For example, even in a slot indicating that medium detection is designated by recording-associated data, there is a case that no recording data (namely, a white data) exists in the slot. In this case, since ink is not ejected to that slot, it is necessary to determine whether or not a medium exists.

For example, in the XML description example (c) described above, information on the slots is described in Lines 07 to 10. X="6" and y="6" in the first slot define the upper left coordinates of the slot, and width="48" and height="48" define the slot size (mm). In a case where these values are converted on the basis of the number of pixels with a recording resolution of 600 dpi, it is obtained that x=50 px, y=50 px, width=400 px, height=400 px. In a case where the area of the image data in the recording data is white data (R, G, B=255, 255, 255), since it is not necessary to determine whether or not a medium exists, detection is not performed. By performing these processes by the image processing unit 508 in FIG. 5 and transmitting the result to the medium detection unit 507, detection can be skipped. As a result, it is possible to reduce unnecessary medium detection.

Fourth Embodiment

In the first embodiment, in a case where there is a slot where no medium is arranged as a result of the determination as to whether or not a medium exists, the recording process is stopped, and a warning notice indicating the message is given to the user. However, the invention is not limited to this example. For example, after determining whether or not a medium exists, in a case where there is a slot where no medium is arranged, by replacing the image portion of the recording data of the medium corresponding to the slot with white data to generate new recording data, the recording may be continued. In this case, similarly to the third embodiment, the area of the slot is specified, and the image processing unit 508 replaces the area with white data.

Fifth Embodiment

Similarly to the tray illustrated in FIG. 4C, in a case of a tray having vertically symmetrical slots, there is a possibility that a user arranges a medium in a state that the medium is erroneously inverted upside down. In this case, similarly to the first embodiment, a warning notice may be given to the user after it is determined whether or not a medium exists. However, if the image can be automatically rotated and recorded, the recording may be configured to be performed.

Figure 12A:
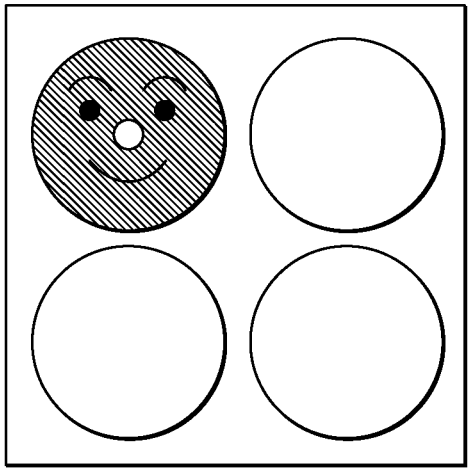
FIGS. 12A and 12B are diagrams illustrating examples of recorded contents.
Figure 12B:
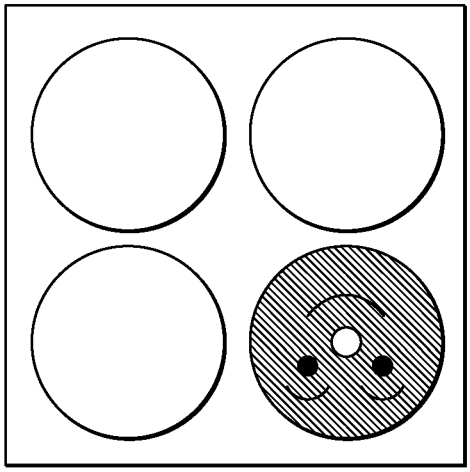

For example, as illustrated in FIG. 12A, there is a case where content in which an image is arranged only at the upper left is recorded. In this case, normally, the user arranges the medium in the upper left slot by using the tray illustrated in FIG. 4C. However, due to errors in recognition of the conveyance direction of the tray or the like, it is considered that the medium in the lower right slot is arranged erroneously by inverting the slot upside down. In such a case, the image processing unit 508 rotates the image by 180 degrees and converts the image into an image as illustrated in FIG. 12B to perform recording. For example, similarly to the third embodiment, with respect to the determining whether or not recording by rotating can be performed, the image processing unit 508 first determines whether or not the image information other than white data exists in an area corresponding to each slot of recording data. As a result, it is determined that the image exists only in the upper left slot. Next, the medium detection unit 507 performs medium detection for each slot and determines that the medium is arranged in the lower right slot. In this case, similarly to the third embodiment, in a case where a medium of a slot where a white image exists is not detected, it cannot be determined whether or not a medium is erroneously arranged. Therefore, in this embodiment, the medium detection unit 507 also performs the medium detection for the slot where the white image exists. The image processing unit 508 determines whether rotation by 180 degrees can be performed on the basis of information as to whether or not an image exists in each slot and information as to whether or not a medium is arranged in each slot. In addition, similarly, in a case where recording can be performed by upside-down inversion, and left-right inversion, recording may be configured to be performed by inversion. As a result, recording can be continuously performed without laboriously re-arranging the medium.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the above configuration, recording intended by the user can be executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-109507, filed May 31, 2016, which is hereby incorporated by reference wherein in its entirety.

What is claimed is:

1. A recording apparatus performing recording on a recording medium by using a tray having a plurality of slots where a recording medium can be arranged, comprising:

a reception unit configured to receive information for specifying a detection position of the recording medium in a slot of the tray from an external apparatus;

a specification unit configured to specify the detection position on the basis of the information for specifying; and a control unit configured to control the recording apparatus so that, in a case where the recording medium is arranged in a first slot corresponding to the specified detection position and no recording medium is arranged in a second slot corresponding to the specified detection position, recording processing is performed on the recording medium arranged in the first slot, and recording processing is not performed in association with the second slot, wherein detection processing to detect whether a recording medium is arranged or not is not performed for a third slot which is not specified by the specification unit, and detection processing is performed for the first and second slots which are specified by the specification unit.

2. The recording apparatus according to claim 1, wherein the information for specifying the detection position includes coordinate information of the detection position.

3. The recording apparatus according to claim 1, further comprising an obtaining unit configured to perform measurement on the specified detection position and obtain a measurement value, wherein the information for specifying the detection position includes information on a slot for which the measurement is not performed.

4. The recording apparatus according to claim 1, further comprising an obtaining unit configured to perform measurement on the specified detection position and obtain a measurement value, wherein the obtaining unit determines a slot for which the measurement is not performed on the basis of the information for specifying the detection position and information on an image to be recorded.

5. The recording apparatus according to claim 1, wherein a reflecting plate or a predetermined pattern that can be measured by an optical sensor is provided at the detection position.

6. The recording apparatus according to claim 1, further comprising an obtaining unit configured to perform measurement on the specified detection position and obtain a measurement value, wherein the obtaining unit measures the detection position by using an optical sensor, and the control unit performs the control on the basis of a difference in optical characteristics between the tray and the recording medium in the measurement value.

7. The recording apparatus according to claim 1, further comprising an output unit configured to output information indicating that a warning is issued to a user in a case where there is a slot where no recording medium is arranged.

8. The recording apparatus according to claim 1, wherein, in a case where there is a slot where no recording medium is arranged, the control unit performs control so as to generate an image by converting an area of the slot where no recording medium is arranged into a white image and perform recording.

9. The recording apparatus according to claim 1, further comprising an obtaining unit configured to perform measurement on the specified detection position and obtain a measurement value, wherein, in a case where it is determined that there is no image information corresponding to the slot where the recording medium is arranged and there is image information corresponding to the slot where no recording medium is arranged on the basis of the measurement value obtained by the obtaining unit and the information of the image to be recorded, the control unit determines whether or not recording can be performed by rotation by 180 degrees, upside-down inversion, or left-right inversion, and if the recording can be performed, the control unit controls the recording apparatus so that the recording can be performed by rotation by 180 degrees, upside-down inversion, or left-right inversion as a process on the image information.

10. A recording method in a recording apparatus performing recording on a recording medium by using a tray having a plurality of slots where a recording medium can be arranged, comprising:

receiving information for specifying a detection position of the recording medium in a slot of the tray from an external apparatus;

specifying the detection position on the basis of the information for specifying; and controlling the recording apparatus so that, in a case where the recording medium is arranged in a first slot corresponding to the specified detection position and no recording medium is arranged in a second slot corresponding to the specified detection position, recording processing is performed on the recording medium arranged in the first slot, and recording processing is not performed in association with the second slot, wherein detection processing to detect whether a recording medium is arranged or not is not performed for a third slot which is not specified, and detection processing is performed for the first and second slots which are specified.

11. The recording method according to claim 10, wherein the information for specifying the detection position includes coordinate information of the detection position.

12. The recording method according to claim 10, further comprising performing measurement on the specified detection position and obtaining a measurement value, wherein the information for specifying the detection position includes information on a slot for which the measurement is not performed.

13. The recording method according to claim 10, further comprising performing measurement on the specified detection position and obtaining a measurement value, wherein a slot for which the measurement is not performed is determined on the basis of the information for specifying the detection position and information on an image to be recorded.

14. The recording method according to claim 10, wherein a reflecting plate or a predetermined pattern that can be measured by an optical sensor is provided at the detection position.

15. The recording method according to claim 10, further comprising performing measurement on the specified detection position and obtaining a measurement value, wherein the measurement on the detection position is performed by using an optical sensor, and it is determined whether or not a recording medium is arranged in a slot of the tray on the basis of a difference in optical characteristics between the tray and the recording medium in the measurement value.

16. The recording method according to claim 10, further comprising outputting information indicating that a warning is issued to a user in a case where there is a slot where no recording medium is arranged.

17. The recording method according to claim 10, wherein, in a case where there is a slot where no recording medium is arranged, an image is generated by converting an area of the slot where no recording medium is arranged into a white image.

18. The recording method according to claim 10, further comprising performing measurement on the specified detection position and obtaining a measurement value, wherein, in a case where it is determined that there is no image information corresponding to the slot where the recording medium is arranged and there is image information corresponding to the slot where no recording medium is arranged on the basis of the obtained measurement value and the information of the image to be recorded, it is determined whether or not recording can be performed by rotation by 180 degrees, upside-down inversion, or left-right inversion, and if the recording can be performed, rotation by 180 degrees, upside-down inversion, or left-right inversion is performed as a process on the image information.

19. A recording apparatus performing recording on a recording medium by using a tray having a plurality of slots where a recording medium can be arranged, comprising:

a memory containing instructions; and at least one processor in communication with the memory, wherein the at least one processor executes the instructions to:

receive information for specifying a detection position of the recording medium in a slot of the tray from an external apparatus;

specify the detection position on the basis of the information for specifying; and control the recording apparatus so that, in a case where the recording medium is arranged in a first slot corresponding to the specified detection position and no recording medium is arranged in a second slot corresponding to the specified detection position, recording processing is performed on the recording medium arranged in the first slot, and recording processing is not performed in association with the second slot, wherein detection processing to detect whether a recording medium is arranged or not is not performed for a third slot which is not specified, and detection processing is performed for the first and second slots which are specified.

* * * * *